United States Patent [19]

Nakamura et al.

[11] Patent Number: 4,588,371

[45] Date of Patent: May 13, 1986

[54] SAFETY DEVICE FOR POT-TYPE OIL BURNER

[75] Inventors: Kazuharu Nakamura; Motoki Matsumoto; Tooru Yoshino, all of Nagoya; Osamu Niha, Aichi, all of Japan

[73] Assignee: Toyotomi Kogyo Co., Ltd., Aichi, Japan

[21] Appl. No.: 593,009

[22] Filed: Mar. 23, 1984

[30] Foreign Application Priority Data

Mar. 29, 1983 [JP] Japan ..... 58-53030

[51] Int. Cl.[4] ..... F23N 5/26

[52] U.S. Cl. ..... 431/14; 431/80; 431/331; 431/78; 126/93; 137/66

[58] Field of Search ..... 431/13, 14, 75, 77, 431/78, 195, 196, 200, 201, 331-342, 64, 80; 374/179; 126/95, 96, 93; 340/584; 137/65, 66

[56] References Cited

U.S. PATENT DOCUMENTS

| | | | |
|---|---|---|---|
| 2,688,999 | 9/1954 | Van Tubergen | 431/64 |
| 3,102,577 | 9/1963 | Dekker | 431/196 |
| 3,920,375 | 11/1975 | Sanderson et al. | 431/78 |
| 4,392,813 | 7/1983 | Tanaka et al. | 431/201 X |
| 4,402,664 | 9/1983 | Kutrieb | 431/79 |
| 4,428,726 | 1/1984 | Kimpara et al. | 431/78 |

*Primary Examiner*—Margaret A. Focarino

*Attorney, Agent, or Firm*—Pollock, Vande Sande & Priddy

[57] ABSTRACT

A safety device for a pot-type oil burner is disclosed which is capable of efficiently and rapidly detecting the decrease of oxygen concentration in a room due to combustion to provide a warning and/or stop the combustion by sensing the decrease in temperature of a bottom portion of a pot. The safety device includes a thermo-sensitive device arranged on the outer surface of the bottom portion of the pot which is apart from the bottom region of the pot in which occurs the vaporization of fuel oil supplied to the pot.

13 Claims, 4 Drawing Figures

SAFETY DEVICE FOR POT-TYPE OIL BURNER

BACKGROUND OF THE INVENTION

1. Field of the Invention

This invention relates to a safety device for a pot-type oil burner and more particularly to a safety device for an oil burner of the type of discharging exhaust gas due to combustion directly to the interior of a room which is adapted to detect the decrease in oxygen concentration in a room.

2. Description of the Prior Art

An oil burner or oil heater is generally separated into two groups, one being the type of discharging exhaust gas to the exterior and the other being the type of discharging it directly to the interior. An oil burner of the latter type is predominantly used because of having advantages such as an excellent good heating efficiency, a low consumption of fuel oil and the like as compared with the former.

However, the use of an oil burner of the latter type often causes the decrease of oxygen concentration in the interior of a room to cause incomplete combustion and adversely affect the human body.

In order to eliminate such defects, a conventional pot-type oil burner of the latter type is provided with a temperature sensing device at a pot. However, the conventional temperature sensing device is adapted to stop combustion of a burner when the pot is heated to an abnormally high temperature, thus, the conventional oil burner substantially causes the decrease in oxygen concentration, the abnormal combustion and the incomplete combustion.

Accordingly, it would be highly desirable to develop a safety device for a pot-type oil burner which is capable of effectively and rapidly detecting the decrease in oxygen concentration prior to the abnormal combustion to inform it and/or stop the combustion.

SUMMARY OF THE INVENTION

The present invention has been made in view of the foregoing disadvantage of the prior art by taking notice of the fact that the temperature of a bottom portion of a pot during normal combustion conditions generally reaches about 300°~420° C., supposing that the combustion conditions are constant such as atmospheric pressure, the temperature of a room and the like; and that the relationship between the temperature of this bottom portion of the pot, in each of various pot-type oil burners having different heat values, and the oxygen concentration in a room is positively as follows:

| Oxygen concentration (%) | temperature* (°C.) |
|---|---|
| 21 | about 300~420 |
| 20 | 290~410 |
| 19 | 250~390 |
| 18 | 210~350 |
| 17 | 180~280 |
| 16 | ~230 |
| 15 | ~180 |

*Temperature was measured by a thermometer arranged on the outer surface of the bottom of a pot and apart from the bottom region of the pot which allows the vaporization of fuel oil.

Thus, it will be understood that such fact clearly reveals that there is a close correlation between oxygen concentration in a room and the temperature of the bottom of a pot.

This would be for the reason that the decrease in oxygen concentration weakens combustion taking place in close proximity to through-holes of the pot for supplying air therethrough to the pot, so that combustion is upwardly moved in the pot to cause the temperature of the whole pot to be decreased. Another reason would be that the lack of air required for burning fuel oil supplied to the pot causes fuel oil to form a mass on the bottom of the pot to decrease the temperature of the bottom.

Accordingly, it is an object of the present invention to provide a safety device for a pot-type oil burner which is capable of effectively and rapidly detecting the decrease of oxygen concentration in a room due to combustion.

It is another object of the present invention to provide a safety device for a pot-type oil burner which is capable of rapidly detecting the decrease of oxygen concentration in a room and providing a warning to inform a person of it, to thereby prevent an injury to the human body.

It is a further object of the present invention to provide a safety device for a pot-type oil burner which is capable of effectively and rapidly detecting the decrease of oxygen concentration in a room and providing a signal to inform a mechanism for stopping the combustion.

It is still a further object of the present invention to provide a safety device for a pot-type oil burner which is capable of carrying out the above-mentioned objects with a simple structure.

In accordance with the present invention, there is provided a safety device for a pot-type oil burner comprising a thermo-sensitive device arranged on the outer surface of the bottom of a pot of said burner, said thermo-sensitive device being positioned apart from the bottom region of said pot in which occurs the vaporization of fuel oil supplied to said pot; and at least one of a warning means and a combustion stop mechanism, which is adapted to actuate when a temperature detected by said thermo-sensitive device is below a set temperature.

According to another aspect of the present invention, there is provided a safety device for a pot-type oil burner comprising a thermo-sensitive device arranged on the outer surface of the bottom of a pot of said burner, said thermo-sensitive device being positioned apart from the bottom region of said pot which allows the vaporization of fuel oil supplied to said pot; and at least one of a warning means and a combustion stop mechanism for eliminating any of factors which carry out continuation of combustion in said pot to stop the combustion, which is adapted to actuate upon receipt of a signal generated from said thermo-sensitive device when a temperature detected by said thermo-sensitive device is below a set temperature.

According to a further aspect of the present invention, there is provided a safety device for a pot-type oil burner comprising a thermo-sensitive device arranged on the outer surface of the bottom of a pot of said burner, said thermo-sensitive device being positioned apart from the bottom region of said pot which allows the vaporization of fuel oil supplied to said pot; and a warning means and a combustion stop mechanism which are adapted to actuate upon receipt of a signal generated from said thermo-sensitive device when a temperature detected by said thermo-sensitive device is below a set temperature.

According to still a further aspect of the present invention, there is provided a safety device for a pot-type oil burner comprising a thermo-sensitive device arranged on the outer surface of the bottom of a pot of said burner, said thermo-sensitive device being positioned apart from the bottom region of said pot which allows the vaporization of fuel oil supplied to said pot and comprising a thermistor having a negative temperature coefficient; a warning means; and a combustion stop mechanism; said combustion stop mechanism comprising a pump control circuit for actuating a fuel pump serving to supply fuel oil to said pot and a burner thermo-circuit for supplying a stop signal to said pump control circuit, said burner thermo-circuit including said thermistor; said burner thermo-circuit comprising a circuit for generating first reference voltage corresponding to a temperature of said pot obtained when oxygen concentration in a room is somewhat above a predetermined level and a circuit for generating second reference voltage corresponding to a temperature of said pot obtained when said concentration decreases to said predetermined level, so that said burner thermo-circuit actuates said warning means when voltage of said thermistor is between said first reference voltage and said second reference voltage, and generates said stop signal when said voltage is below said second reference voltage.

BRIEF DESCRIPTION OF THE DRAWINGS

Other objects and many of the attendant advantages of the present invention will be readily appreciated as the same becomes better understood by reference to the following detailed description when considered in connection with the accompanying drawings wherein.

DETAILED DESCRIPTION OF THE PREFERRED EMBODIMENTS

Now, a safety device for a pot-type oil burner according to the present invention will be described with reference to the accompanying drawings.

Figure 1:
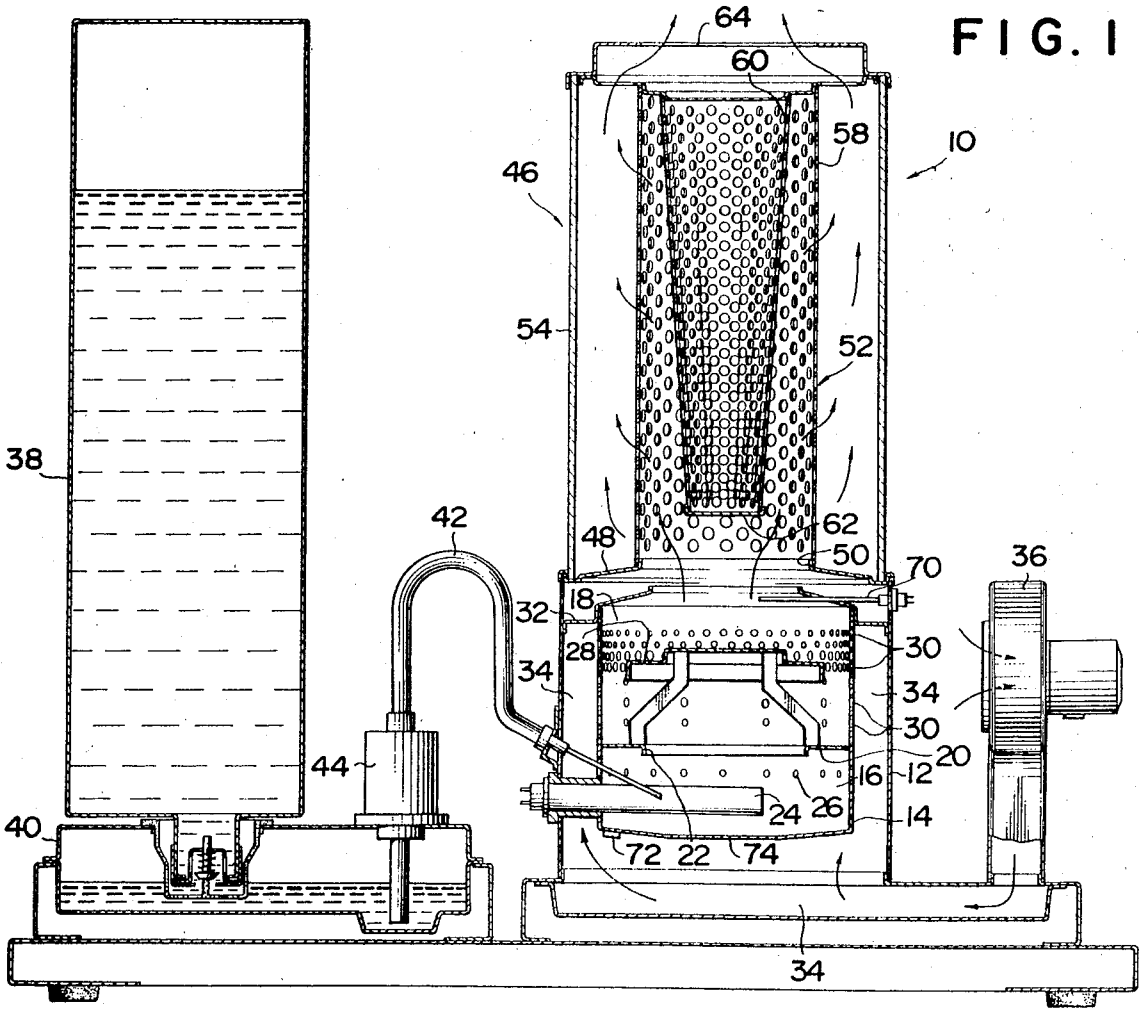
FIG. 1 is a vertical sectional view showing an example of a pot-type oil burner having an embodiment of a safety device according to the present invention incorporated therein.

FIG. 1 illustrates an example of a pot-type oil burner in which a safety device according to the present invention is to be incorporated. The pot-type oil burner illustrated in FIG. 1 is generally designated by reference numeral 10 and in the form of a red-heated oil space heater, however, it should be noted that a pot-type oil burner in which a safety device of the present invention is to be employed is not limited to such a red-heated space heater. Also, the illustrated burner is adapted to discharge exhaust gas directly to the interior of a room.

The pot-type oil burner 10 includes a housing 12 and a pot 14 received in the housing. The pot 14 is adapted to accomplish the vaporization and ignition of fuel oil such as kerosene supplied thereto and the combustion of vaporized fuel oil therein. The pot 14 has a lower chamber 16 and an upper chamber 18 formed therein which are separated from each other by a horizontal partition 20 having an opening 22 formed at the central portion thereof, through which the chambers 16 and 18 are communicated with each other. The lower chamber 16 has an electric heater 24 arranged therein, which acts to heat fuel oil supplied to the pot 14 to vaporize it and ignite vaporized fuel oil using air mainly fed from through-holes 26 formed at the side wall of the lower chamber 16.

The upper chamber 18 has a plate means 28 arranged therein above the opening 22 and formed into an inverted dish shape, which serves to spread flame of fuel oil ignited in the lower chamber 16 and carry out substantial combustion of vaporized fuel oil using air fed to the chamber 18 through a plurality of through-holes 30 formed at the side wall thereof.

In the example illustrated, the pot 14 is suspended in the housing 12 by means of a top plate 32 of the pot 14 extending from the pot to the housing 12, so that an air supply passage 34 may be defined between the housing 12 and the pot 14 which acts to supply air from an air fan 36 therethrough to the pot 14. The air supply passage 34 is communicated via the through-holes 26 and 30 of the pot 14 to the pot.

In the normal combustion operation of the oil burner 10, flame formed due to normal combustion in the pot 14 extends to the upper end of the top plate 32 of the pot.

The pot-type oil burner 10 also includes an oil supply means for supplying fuel oil to the pot 14. The oil supply means comprises an oil tank 38, an oil reservoir 40 and an oil supply pipe 42. The oil reservoir 40 permits the tank 38 to be supported thereon in an inverted manner and keeps the level of fuel oil substantially constant therein. Fuel oil is forcedly fed by means of an electromagnetic pump 44 provided between the oil supply pipe 42 and the oil reservoir 40.

Furthermore, the pot-type oil burner 10 includes a multiple combustion cylinder construction 46 supported on a top plate 48 of the housing 12, at the central portion of which an opening 50 is formed to communicate the pot 14 therethrough with the combustion cylinder construction. The combustion cylinder construction 46 is adapted to discharge heat rays and exhaust gas therefrom to the interior of a room. More specifically, the construction 46 includes a red-heated cylinder means 52 and a heat-permeable cylinder 54 arranged to surround the cylinder means 52 with a space being defined therebetween. The cylinder means 52 consists of an outer perforated cylinder 58 and an inner perforated cylinder 60 disposed concentrical with the outer cylinder 58 and having a seal plate 62 attached to the lower end thereof. In the construction 46, heat generated due to combustion in the pot 14 renders the cylinders 58 and 60 red-heated, to thereby allow the cylinders 58 and 60 to emit heat rays therefrom; and exhaust gas due to combustion is discharged from the construction 46 via an opening 64 formed at the top of the construction 46 to the interior of a room.

Furthermore, the pot-type oil burner 10 includes a flame electrode 70 in the form of a rod. The electrode 70 is supported by the housing 12 and inserted through the top plate 32 of the pot 14 to the space of the pot at which the electrode 70 is constantly surrounded by flame formed due to normal combustion in the pot 14. The electrode 70 is electrically insulated from the pot 14, and AC voltage is applied between the pot 14 and the electrode 70.

A safety device of the present invention incorporated in the oil burner constructed in the manner as described above includes a thermo-sensitive device designated by reference numeral 72. The thermo-sensitive device 72 is arranged on the outer surface of the bottom of the pot 14 and at the position except or apart from the bottom region 74 of the pot 14 in which occurs the vaporization of fuel oil supplied to the pot. In the embodiment, a thermistor is used as the thermo-sensitive device 72.

A further construction of the safety device will be described hereinafter together with the manner of operation thereof in relation to the pot-type oil burner with reference to FIGS. 1 to 3.

Figure 2:
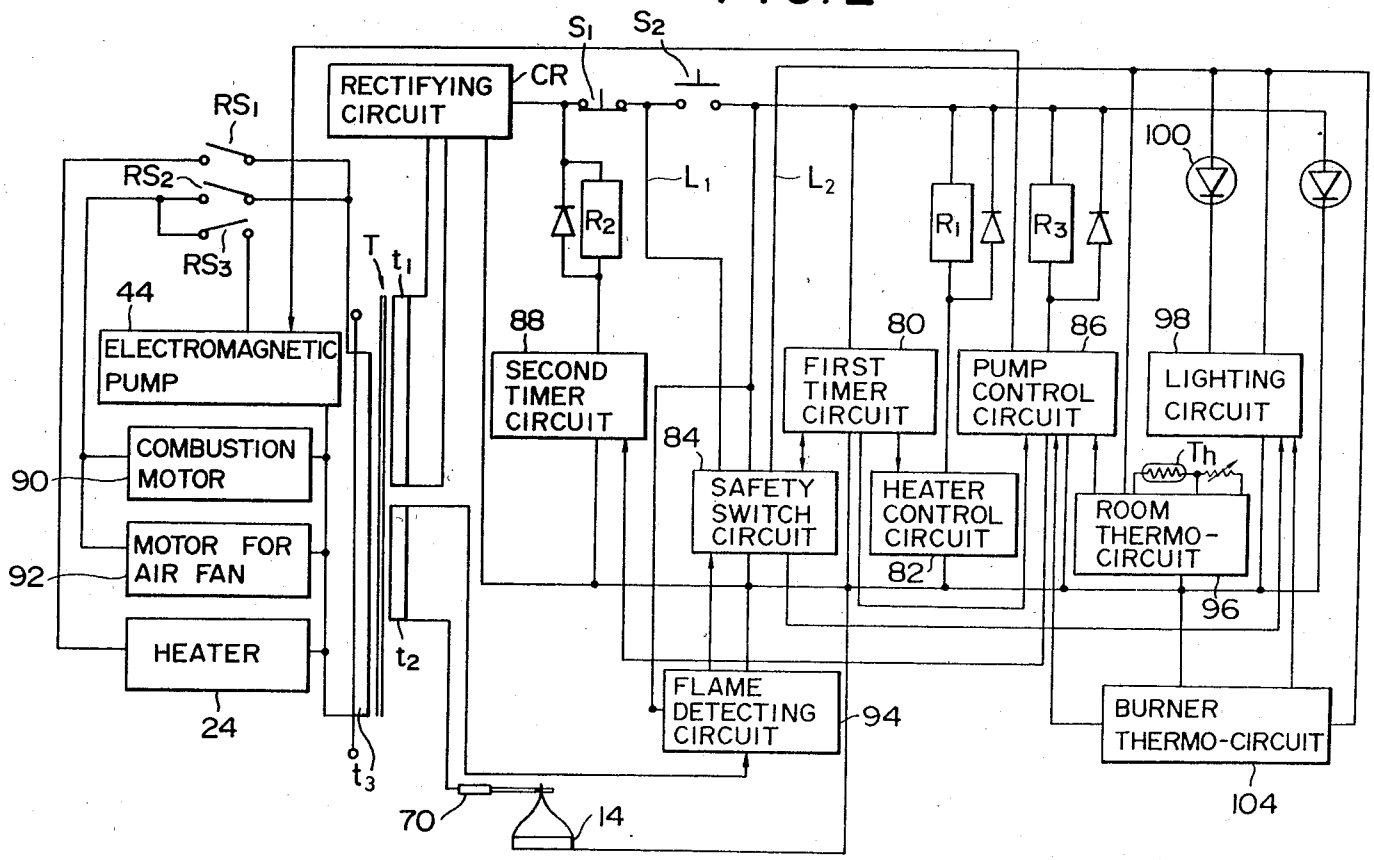
FIG. 2 is a circuit diagram illustrating one example of a circuit employed in the burner shown in FIG. 1.

In FIG. 2, reference character T designates a power transformer, and a winding $t_1$ thereof is connected at the both ends thereof with a rectifying circuit CR. $S_1$ and $S_2$ indicate control switches wherein the switch $S_1$ is a normal close-type switch and $S_2$ is a normal open-type push button switch.

First, the ignition operation of the oil burner will be described with reference to FIG. 2.

When the switch $S_2$ is closed, electric current is supplied from the rectifying circuit CR to a first timer 80, a heater control circuit 82 and the like. A safety switch circuit 84 includes a known holding circuit, and acts to continue the supply of current from the power source through lines $L_1$ and $L_2$ to the first timer 80, the heater control circuit 82 and a pump control circuit 86 when the switch $S_2$ has been opened. When current is supplied to the heater control circuit 82, a relay $R_1$ is actuated to close a relay switch $RS_1$ corresponding thereto, to thereby allow current to be supplied to the heater 24 concurrently with closing of the switch $S_2$ to heat the pot 14.

The first timer circuit 80 starts to count upon closing of the switch $S_2$ and feeds an actuating signal to the pump control circuit 86 in a predetermined time to allow the circuit 86 to operate. The actuation of the circuit 86 causes current to be flowed through a relay $R_3$ to close a relay switch $RS_3$, and concurrently supplies an actuating signal to a second timer circuit 88. This allows current to be flowed through a relay $R_2$ to close a relay switch $RS_2$ corresponding thereto. The transformer T has a winding $t_3$ of which both ends are connected to an AC power supply (not shown) so that the concurrent closing of the relay switches $RS_2$ and $RS_3$ allows current to be supplied from the winding $t_3$ of the transformer T to a combustion motor 90, a motor 92 for the air fan 36 and the electromagnetic pump 44; resulting in the motors 90 and 92 and the pump 44 starting to actuate. Thus, the closing of the switches $RS_2$ and $RS_3$ carries out the ignition, because the heater 24 previously heats the pot to a high temperature. The combustion motor 90 serves to circulatingly supply air in a room therethrough to the combustion cylinder construction 46 to positively discharge combustion heat to the interior of the room, to thereby convectively heat the room as well.

The pump control circuit 86 includes a timer, which is adapted to actuate the electromagnetic pump 44 to supply to the pot 14 fuel oil at a flow rate larger than that in the normal combustion operation during a predetermined period of time after the ignition. When the timer of the pump control circuit 86 counts the predetermined time, the electromagnetic pump starts the normal operation to supply fuel oil at a flow rate lower than that during the ignition operation.

A winding $t_2$ of the power transformer T is electrically connected at one end thereof to the flame electrode 70 and at the other end thereof to the input terminal of a flame detecting circuit 94. The flame electrode 70 is adapted to detect flame utilizing the rectifying action of flame. In the embodiment, the pot 14 serves as a counter electrode having earth potential. Flame between the pot and the flame electrode causes DC voltage to appear at the input terminal of the flame detecting circuit 94 due to the rectifying action of flame, so that the circuit 94 generates a flame detecting signal.

When the timer 80 counts the predetermined time after the switch $S_2$ is closed, the safety switch circuit 84 connects a room thermo-circuit 96 and a control circuit 98 for a warning means with the power source. This results in the circuits 96 and 98 being in an actuating state. The timer further carries out when a flame detecting signal is supplied to the safety switch circuit 84; and after it counts a predetermined time, it supplies to the heater control circuit 82 a stop signal for stopping the supply of current to the heater 24. This results in the heater control circuit 82 stopping the supply of current to the relay $R_1$ to cause the relay switch $RS_1$ to be opened, to thereby stop the supply of current to the heater 24.

When the flame detecting circuit 94 does not generate a flame detecting signal or stops the generation of a flame detecting signal, the safety switch circuit 84 actuates the control circuit 98 to actuate a warning means 100. In the embodiment, the control circuit 98 and the warning means 100 are in the form of a lighting circuit and an alarm lamp, respectively. Also, when the timer 80 detects that a flame detecting signal is not supplied to the safety switch circuit 84, it supplies a stop signal to the heater control circuit 82 and the pump control circuit 86. This causes the relay switches $RS_1$ and $RS_3$ to be opened to stop the combustion operation. When the warning means or alarm lamp 100 is lighted, the switch $S_1$ is manually pushed. The re-ignition operation is carried out by pushing the switch $S_2$ again.

Now, the extinguishing operation of the pot-type oil burner will be described.

When the switch $S_1$ is pushed, the safety switch circuit 84 is released from the self holding state to stop the supply of current from the power source to the pump control circuit 86 and the like. This causes the relay switch $RS_3$ to be opened to stop the actuation of the electromagnetic pump 44 to gradually promote the extinguishing. When the supply of current to the pump control circuit 86 is stopped, the timer 88 starts to count and stops the supply of current to the relay $R_2$ in a predetermined time. This results in the relay switch $RS_2$ being opened to stop the motors 90 and 92, to thereby carry out the extinguishing.

The manner of operation of the room thermo-circuit 96 and a burner thermo-circuit 104 will be described hereinafter.

The room thermo-circuit 96 serves to detect the temperature of a room by means of a thermistor Th to supply a signal to the pump control circuit 86 which is required to carry out desired combustion in view of the detected temperature.

The burner thermo-circuit 104 acts to supply a control signal to the lighting circuit 98 and pump control circuit 86 when it detects that the temperature of the pot 15 is below a set temperature, and the lighting circuit 98 actuates the warning lamp 100 and the pump control circuit 86 concurrently stops the supply of current to the relay $R_3$ to stop the electromagnetic pump 44. When the electromagnetic pump is stopped to stop the combustion, the flame detecting circuit 94 generates a flame detecting signal no longer; thus, the safety switch circuit 84 supplies a signal to the lighting circuit 98 to light the warning lamp 100. Also, when the pump control circuit 86 stops the supply of current to the relay $R_3$, the timer 88 concurrently starts to count and stops the supply of current to the relay $R_2$ in a predetermined time to open the relay switch $RS_2$, to thereby stop the motors 90 and 92.

Figure 3:
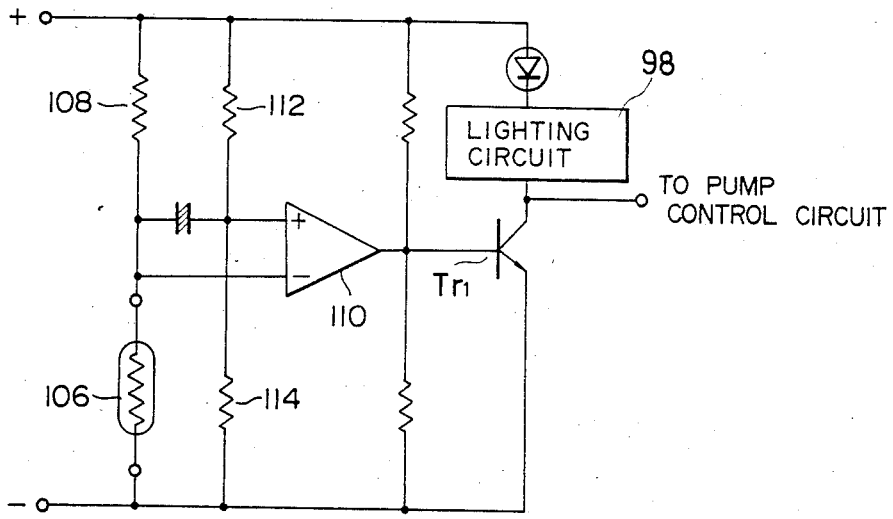
FIG. 3 is a circuit diagram showing one example of a burner thermo-circuit for a safety device of the present invention shown in FIG. 2.

FIG. 3 shows one example of the burner thermo-circuit 104. In FIG. 3, reference numeral 106 designates a thermistor having a negative temperature coefficient which acts as the thermo-sensitive element 72 attached to the bottom of the pot 14. The thermistor 106 is electrically connected through a resistor 108 to the power source, and the connection between the resistor 108 and the thermistor 106 is connected to the negative terminal of a comparator 110. The positive terminal of the comparator 110 is connected to the connection between resistors 112 and 114. The resistors 112 and 114 each serve as a voltage divider for forming reference voltage corresponding to or representing the set temperature. The output terminal of the comparator 110 is connected to the base of a transistor $Tr_1$, and the collector of the transistor is connected to the input terminals of the lighting circuit 98 and pump control circuit 86.

The thermistor 106 is adapted to decrease and increase in resistance with the increase and decrease in temperature of the pot 14, respectively, and generates voltage corresponding to the temperature of the pot across the both ends thereof. The voltage divider comprising the resistors 112 and 114 serves to form reference voltage corresponding to the temperature of the pot 14 when oxygen concentration in a room is below the predetermined level. The resistance of each of the resistors 112 and 114 is determined dependent upon heat value of an oil burner into which the safety device of the present invention is to be incorporated. The temperature of the pot is below the predetermined level prior to the starting of combustion; and, in this case, when the burner thermo-circuit 104 is connected to the power source, it would be actuated. However, the safety switch circuit 84 does not connect the room thermo-circuit 96, lighting circuit 98 and burner thermo-circuit 104 to the power source unless the timer 80 carries out counting of a predetermined time after the switch $S_2$ is closed; thus, the burner thermo-circuit 104 is not actuated.

When the combustion normally starts and the burner thermo-circuit 104 is connected to the power source, the thermistor 106 supplies voltage corresponding to a temperature detected by the comparator 110. When the temperature of the pot 14 is decreased, voltage across the both ends thereof is increased. When the voltage is above reference voltage, potential at the output terminal of the comparator 110 is changed from a low (L) level to a high (H) level to supply current to the base-emitter circuit of the transistor $Tr_1$. When the transistor is conductive, the lighting circuit 98 is actuated to light the warning or alarm lamp 100. It is of course that a sound means such as a buzzer may be used as the warning means 100 instead of the alarm lamp. Also, when the transistor $Tr_1$ is conductive, a signal is also supplied to the pump control circuit 86, which stops the supply of electric current to the relay $R_3$ to stop the electromagnetic pump 44.

In the illustrated embodiment, a thermistor is used as the thermo-sensitive device 72. Alternatively, any of other thermo-sensitive devices known in the art may be used in the present invention.

Figure 4:
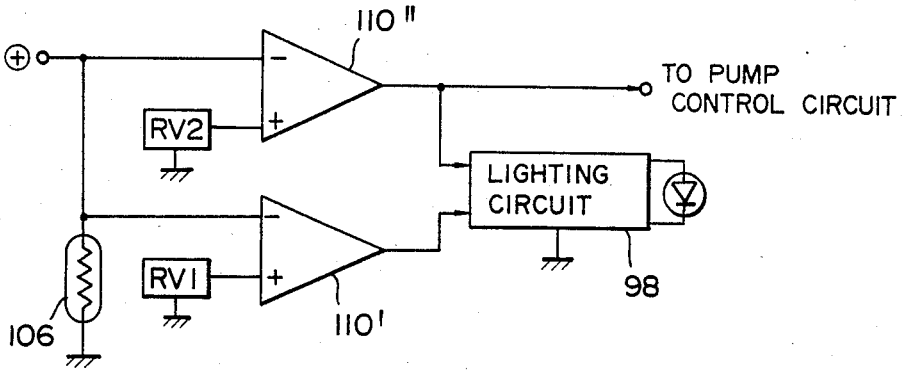
FIG. 4 is a circuit diagram showing another example of a burner thermo-circuit.

Also, the burner thermo-circuit 104 may comprise two circuits for forming first and second reference voltages $RV_1$ and $RV_2$ and two comparators 110' and 110'', as shown in FIG. 4. The first reference voltage corresponds to the temperature of the bottom of the pot 14 obtained when oxygen concentration in a room somewhat exceeds a predetermined level, and the second reference voltage corresponds to the temperature of the pot 14 obtained when the concentration is decreased to the predetermined level. A thermistor 106 has a negative temperature coefficient as in FIG. 2. When oxygen concentration in a room is decreased to cause the temperature of the pot to be decreased, resulting in the voltage of the thermistor 106 exceeding the first reference voltage, the comparator 110' supplies a signal to the lighting circuit 98 to actuate the lamp 100. When the temperature of the pot is further decreased to cause the voltage of the thermistor 106 to exceed the second reference voltage, the comparator 110'' supplies to the pump control circuit 86 a signal for stopping the electromagnetic pump 44 and concurrently supplies a signal to the lighting circuit 98 to actuate the lamp 100.

It is of course that the set temperature of the thermo-sensitive device is varied dependent upon heat value of an oil burner into which the safety device of the present invention is to be incorporated. In general, the set temperature would be in the range between 300° C. and 230° C.

It will thus be seen that the objects set forth above, among those made apparent from the preceding description, are efficiently attained and, since certain changes may be made in the above construction without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A safety device for a pot-type oil burner comprising:

a thermo-sensitive device arranged on the outer surface of the bottom of the pot of said burner for vaporizing and burning fuel oil supplied to said pot, said thermo-sensitive device being positioned so as to detect the temperature of a bottom portion of said pot apart from a bottom region of said pot in which occurs the vaporization of said fuel oil supplied to said pot; and a combustion stop mechanism which actuates to stop combustion when the temperature detected by said thermo-sensitive device is below a set temperature;

the temperature of said bottom portion of said post being positively related to the oxygen concentration in room supplying combustion air to said pot when burning said fuel oil therein;

said thermo-sensitive device comprising a thermistor having a negative temperture coefficient; and, said combustion stop mechanism comprising a pump control circuit for actuating a fuel pump serving to supply fuel oil to said pot and a burner thermo-circuit for supplying a stop signal to said pump control circuit, said burner thermo-circuit including said thermistor.

2. A safety device for a pot-type oil burner as defined in claim 1, wherein said burner thermo-circuit serves to compare voltage corresponding to said temperature detected by said thermistor with voltage corresponding to said set temperature and generate said stop signal when the former voltage exceeds the latter voltage.

3. A safety device for a pot-type oil burner as defined in claim 2 further comprising a warning means and a control circuit for actuating said warning means when said stop signal is supplied thereto.

4. A safety device for a pot-type oil burner as defined in claim 3, wherein said warning means comprises an alarm lamp and said control circuit for said warning means comprises a lighting circuit.

5. A safety device for a pot-type oil burner as defined in claim 3, wherein said burner thermo-circuit comprises a circuit for generating a first reference voltage corresponding to a temperature of said pot obtained when oxygen concentration in a room is somewhat above a predetermined level and a circuit for generating a second reference voltage corresponding to a temperature of said pot obtained when said oxygen concentration decreases to said predetermined level, so that said burner thermo-circuit actuates said warning means when voltage across said thermistor is between said first reference voltage and said second reference voltage, and generates said stop signal when said voltage is below said second reference voltage.

6. A safety device for a pot-type oil burner as defined in claim 5, wherein said warning means comprises an alarm lamp.

7. A safety device for a pot-type oil burner as defined in claim 1, wherein said device further includes means for preventing actuation of said at least one of a warning means and a combustion stop mechanism during initial burning of said fuel oil to heat said bottom portion of the pot to a temperature above said set temperature.

8. A safety device for a pot-type oil burner as defined in claim 1, wherein said relationship between the temperature of said bottom portion of the pot and the oxygen concentration in the room supplying combustion air to said pot is as follows:

| Oxygen concentration (%) | temperature (°C.) |
|---|---|
| 21 | about 300~420 |
| 20 | 290~410 |
| 19 | 250~390 |
| 18 | 210~350 |
| 17 | 180~280 |
| 16 | ~230 |
| 15 | ~180 |

9. A safety device for a pot-type oil burner as defined in claim 1 further comprising a warning means and a control circuit for actuating said warning means when said stop signal is supplied thereto.

10. A safety device for a pot-type oil burner comprising:

a thermo-sensitive device arranged on the outer surface of the bottom of a pot of said burner for vaporizing and burning fuel oil supplied to said pot, said thermo-sensitive device being positioned so as to detect the temperature of a bottom portion of said pot apart from a bottom region of said pot in which occurs the vaporization of said fuel oil supplied to said pot; and a combustion stop mechanism for eliminating any of the factors which carry out continuation of combustion in said pot so as to stop the combustion, which is actuated upon receipt of a signal generated from said thermo-sensitive device when the temperature detected by said thermo-sensitive device is below a set temperature;

the temperature of said bottom portion of said pot being positively related to the oxygen concentration in a room supplying combustion air to said pot when burning said fuel oil therein;

said thermo-sensitive device comprising a thermistor having a negative temperature coefficient; and, said combustion stop mechanism comprising a pump control circuit for actuating a fuel pump serving to supply fuel oil to said pot and a burner thermo-circuit for supplying a stop signal to said pump control circuit, said burner thermo-circuit including said thermistor.

11. A safety device for a pot-type oil burner comprising:

a thermo-sensitive device arranged on the outer surface of the bottom of a pot of said burner for vaporizing and burning fuel oil supplied to said pot, said thermosensitive device being positioned so as to detect the temperature of a bottom portion of said pot apart from a bottom region of said pot in which occurs the vaporization of said fuel oil supplied to said pot;

a warning means; and, a control circuit for actuating said warning means upon receipt of a signal generated from said thermo-sensitive device when the temperature detected by said thermo-senisitive device is below a set temperature;

the temperature of said bottom portion of said pot being positively related to the oxygen concentration in a room supplying combustion air to said pot when burning said fuel oil therein; and, said thermo-sensitive device comprising a thermistor having a negative temperature coefficient and a burner thermo-circuit for supplying said signal to said warning means control circuit, said burner thermo-circuit including said thermistor.

12. A safety device for a pot-type oil burner as defined in claim 11, wherein said warning means comprises an alarm lamp and said control circuit for said warning means comprises a lighting circuit.

13. A safety device for a pot-type oil burner comprising:

a thermo-sensitive device arranged on the outer surface of the bottom of a pot of said burner for vaporizing and burning fuel oil supplied to said pot, said thermo-sensitive device being positioned so as to detect the temperature of a bottom portion of said pot apart from a bottom region of said pot in which occurs the vaporization of fuel oil supplied to said pot and comprising a thermistor having a negative temperature coefficient, and the temperature of said bottom portion of said pot being positively related to the oxygen concentration in a room supplying combustion air to said pot when burning said fuel oil therein;

a warning means; and a combustion stop mechanism;

said combustion stop mechanism comprising a pump control circuit for actuating a fuel pump serving to supply said fuel oil to said pot and a burner thermo-circuit for supplying a stop signal to said pump control circuit, said burner thermo-circuit including said thermistor; and, said burner thermo-circuit comprising a circuit for generating a first reference voltage corresponding to a temperature of said bottom portion of the pot obtained when the oxygen concentration in said room is somewhat above a predetermined level and a circuit for generating a reference voltage corresponding to a temperature of said bottom portion of the pot obtained when said oxygen concentration decreases to said predetermined level, so that said burner thermo-circuit actuates said warning means when the voltage of said thermistor is between said first reference voltage and said second reference voltage, and generates said stop signal when said voltage is below said second reference voltage.

* * * * *